US011840435B2

(12) United States Patent
Iotti

(10) Patent No.: US 11,840,435 B2
(45) Date of Patent: Dec. 12, 2023

(54) SIMULATOR FOR TELEHANDLERS

(71) Applicant: MANITOU ITALIA S.R.L., Castelfranco Emilia (IT)

(72) Inventor: Marco Iotti, Reggio Emilia (IT)

(73) Assignee: MANITOU ITALIA S.R.L., Castelfranco Emilia (IT)

( * ) Notice: Subject to any disclaimer, the term of this patent is extended or adjusted under 35 U.S.C. 154(b) by 261 days.

(21) Appl. No.: 17/205,109

(22) Filed: Mar. 18, 2021

(65) Prior Publication Data

US 2021/0300741 A1 Sep. 30, 2021

(30) Foreign Application Priority Data

Mar. 31, 2020 (IT) ..... 102020000006757

(51) Int. Cl.
*B66F 9/07* (2006.01)
*B66F 9/075* (2006.01)
*B66F 17/00* (2006.01)

(52) U.S. Cl.
CPC ..... *B66F 9/0755* (2013.01); *B66F 17/00* (2013.01)

(58) Field of Classification Search
CPC ..... B66F 17/00; B66F 9/0755; B66F 9/0655; B66F 17/003; B66C 23/905
See application file for complete search history.

(56) References Cited

U.S. PATENT DOCUMENTS 5,813,551 A * 9/1998 Abel ..... B66C 23/80 212/277
9,796,571 B2 10/2017 Singh et al.
2015/0217976 A1 8/2015 Tanizumi et al.
2017/0036894 A1 2/2017 Braun et al.
2020/0277176 A1* 9/2020 Rushton ..... B66F 9/07554
2021/0010281 A1* 1/2021 Müller ..... E04G 21/0436

FOREIGN PATENT DOCUMENTS

CN 104603041 A 5/2015
CN 106436791 A 2/2017
DE 102014105618 A1 10/2015
(Continued)

OTHER PUBLICATIONS

"Notification of material filed by a third party" dated Jan. 17, 2023 and "Third Party Observation" filed on Jan. 17, 2023 in corresponding Australian Patent Application No. 2021201733, 18 pages.
(Continued)

*Primary Examiner* — Tyler J Lee
*Assistant Examiner* — Yufeng Zhang
(74) *Attorney, Agent, or Firm* — Pearne & Gordon LLP; J. Gregory Chrisman

(57) ABSTRACT

A simulation system for telehandlers that are equipped with a movable operating arm designed to lift and move loads, and stabilisers that include a plurality of movable stabilising arms. An acquisition module is configured to receive at least functional parameters relating to operating conditions of the stabilising arms. A calculation module is configured to determine a potential stability condition as a function of the operating parameters. And an output module is configured to provide an operator with information representing the condition of potential stability.

12 Claims, 5 Drawing Sheets

(56) References Cited

FOREIGN PATENT DOCUMENTS

| | | | |
|---|---|---|---|
| EP | 2894120 | A1 | 7/2015 |
| WO | 2020027335 | A1 | 2/2020 |

OTHER PUBLICATIONS

"Merlo range of telehandler products ROTO", web page, 2017, Sollevatori Telescopici Rotativi-ROTO-Merlo S.p.A., cited in "Third Party Observation" filed on Jan. 17, 2023 in corresponding Australian Patent Application No. 2021201733, 1 page.

"ROTO control instructions", M1, Section 3-Commands and Instruments, Video-Graphic Unit, LUM00359-E [M1-TR50-A-01], cited in "Third Party Observation" filed on Jan. 17, 2023 in corresponding Australian Patent Application No. 2021201733, pp. 52-128 through 59-128.

"Press release 1 posed on Internet", web page, Premio al Samoter per ASCS di Merlo (mondomacchina.it), January, Feb. 2017, cited in "Third Party Observation" filed on Jan. 17, 2023 in corresponding Australian Patent Application No. 2021201733, 1 page.

"Press release 2 posted on Internet", web page, Merlo Launches New Equipment at INTERMAT 2018-OEM OffHighway (oemoffhighway.com), May 3, 2018, cited in "Third Party Observation" filed on Jan. 17, 2023 in corresponding Australian Patent Application No. 2021201733, 1 page.

Office action dated Jul. 7, 2023 in Chinese Patent Application No. 202110320808.8, 7 pages.

* cited by examiner

SIMULATOR FOR TELEHANDLERS

This invention relates to a simulator of the operating conditions for telehandlers, which allows the operator to know in advance the possibility of operating the load.

It is known that telehandlers are equipped with a system for limiting the overturning moment, which monitors the variable geometrical parameters of the machine (sliding length of the arm, angle of lifting the arm relative to the horizontal, angle of rotation of the turret relative to the axis of the frame, measurement of the extension of each of the members of the stabilisers, etc.), calculates the maximum permissible load instantaneously and compares it with those indicated in the capacity table loaded in the memory, which represents the structural limits of the machine and apparatus. Based on this comparison, the system determines whether that load can be moved in the circumstances given.

In other words, depending on the current operating conditions, the safety system enables or prevents certain movements of the lifting arm which carries the load.

The presence of obstacles such as walls, bridges, roads, pavements in the work sites can prevent a uniform extension of the stabilisers of the machine, thereby making it difficult for the operator to estimate in advance whether it is possible to lift a certain load and carry it to a specific position in the surrounding space and therefore prevent an efficient planning of the work. In these circumstances, in practice, the operator is forced to stabilise the machine according to the configuration allowed by the working environment and then to try lifting the load, so as to check how the safety system reacts. If the system does not allow the requested manoeuvres to be performed, the operator must return the load to the ground, retracting the stabilisers by lowering the wheels of the telehandler to the ground, and then move it to a position in which it is assumed the work can be performed.

These repeated attempts are not only inconvenient but also wasteful in terms of time and energy consumption.

The technical purpose which forms the basis of the invention is to provide a simulation system for telehandlers which overcomes the limitations of the prior art.

This technical purpose is achieved by the simulation system made according to claim 1.

Further characteristics and advantages of the present invention will more clearly emerge from the indicative and therefore non-limiting description of preferred, non-limiting embodiments of the system of the invention, as illustrated in the accompanying drawings, in which.

Figure 1:
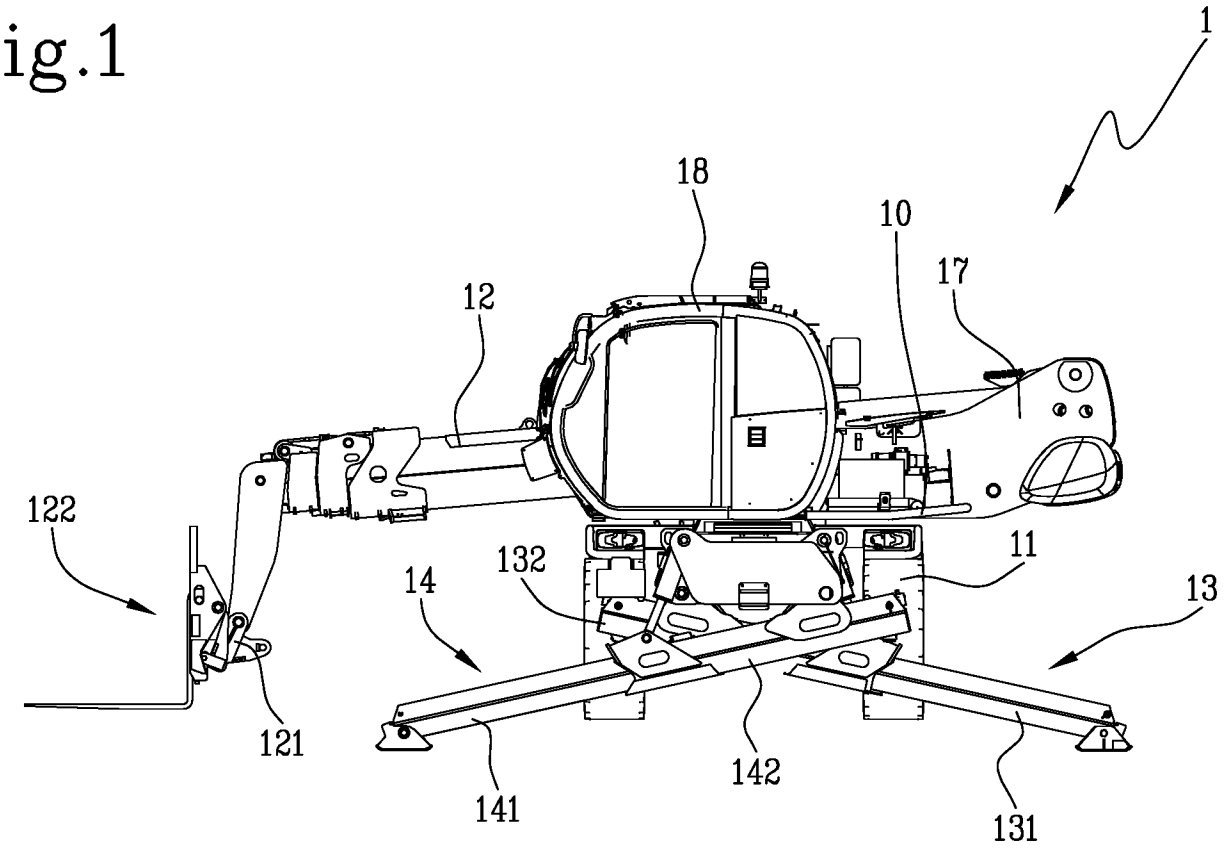
FIG. 1 is a front view of a telehandler with which the invention may operate, stabilised and with its turret turned by ninety degrees relative to the axis of the respective carriage.

With reference to the accompanying drawings, the numeral 1 denotes a telehandler with which the invention can be used.

The telehandler 1 is equipped with a carriage 10 movable on wheels 11, a telescopic operating arm 12, designed to lift and move loads and stabilisers comprising a plurality of stabilising arms 13, 14, 15, 16.

Thanks to the hydraulic cylinders specially provided, the operating arm 12 can be extended and inclined about a hinge with a horizontal axis and is equipped, at its distal end, with a quick coupling device 121 which allows the removable coupling of equipment 122 which hold and carry the load, such as forks, cages, winches, etc.

The telehandler can be fixed, in which case the arm and the cab are mounted directly on the carriage, or rotary (as shown in the drawings), in which case a rotary turret 17, mounted on the carriage 10, bears the arm 12 and the cab 18.

The stabilisers can include four movable stabilising arms 13, 14, 15, 16, two front arms at the front of the carriage and two rear arms, at the rear of the carriage which can, for example, be of the telescopic type and shaped like a scissor, as in the accompanying drawings.

More in detail, in the case of scissor type stabilisers, each stabilising arm includes a hydraulic cylinder for the extension, that is to say, for moving the sliding members 131, 141, 151, 161, relative to the segments 132, 142 (denoted with numerical references only in FIG. 1) in which they are inserted telescopically and a cylinder for rotating the arms, which allows the stabilisers to be moved from the raised position to that of contact with the ground.

The various hydraulic cylinders of the telehandler 1 are driven by an electro-hydraulic distributor controlled by the commands in the cab 18.

The proposed simulation system includes processing means 2 which in turn comprise firstly an acquisition module 21 configured to receive functional parameters which characterise the telehandler 1; the functional parameters can include variable geometrical parameters, that is to say, parameters which refer to the fact that there are parts of the telehandler 1 which change the relative configuration or arrangement or position in space, thereby influencing the operations and/or the stability of the telehandler 1. The acquisition module 21 is designed to receive at least functional parameters relative to operating conditions of said movable stabilising arms 13, 14, 15, 16, such as the fact that they are retracted or extended, or more in detail the degree of elongation of the sliding member 131, 141, 151, 161 the angle of rotation or other conditions which characterise their operation. More in detail, in the case of scissor stabilisers, important functional parameters are those relative to the degree of extension of each sliding member 131, 141, 151, 161, because they constitute a factor which determines the basic stabilising rectangle, that is, the zone of stability A, the sides of which are also called tipping lines T (see diagram in FIG. 4). Preferably, the acquisition module 21 is set up to receive at least one functional parameter representing a position where the operator wishes to position the load C raised or placed by the arm 12; preferably, it is a relative position with respect to the carriage 10 of the telehandler 1 (or in any case a reference integral with the carriage) and included in the surrounding environment.

Moreover, the acquisition module 21 may be set up to receive a functional parameter relating to the load C, in particular relating to its weight. Preferably, the above-mentioned acquisition module 21 may be set up to receive at least one functional parameter relative to the angular position of the above-mentioned turret 17 and/or to receive a functional parameter relative to the height at which said load can be positioned by the arm 12, in the above-mentioned position and a functional parameter concerning a relative horizontal distance where the load C can be located, again in the above-mentioned position.

It should be noted that the acquisition module 21 may be functionally associated with or incorporated in a user interface 22; more specifically, the interface 22 is connected to or integrated with the processing means and is configured for the insertion or selection of the functional parameters by an operator.

In other words, the interface 22 allows the operator to enter the above-mentioned parameters or data relative to the parameters, such as, for example, the weight of the load C to be moved and/or the lateral extension of the individual stabilising arms and/or the relative position (for example Cartesian or polar) where the load be carried and/or the angular position of the turret 17.

Moreover, or alternatively, the operator may be presented by the interface 22, for example by means of graphical indexes on a screen, with predetermined values of one or more of the above-mentioned functional parameters, designed for being selected by the operator.

The telehandler 1 may also be equipped with sensors for measuring the above-mentioned parameters, or data relative to the above-mentioned parameters, such as, for example, position sensors 23 which measure the degree of extension of the individual stabilising arms 13, 14, 15, 16. For this reason, by using the invention, it is possible to have an exclusively manual mode for acquiring the parameters by the processing means 2 or a mixed mode wherein some parameters are acquired manually, that is, entered or selected by the operator, and others are automatically detected by sensors.

Generally speaking, it should be noted that, in the present description, the processing means 2 are presented as being subdivided into separate functional modules solely for the purpose of describing the functions clearly and completely. Basically, the means can include processing units 2 which may consist of an electronic device, also of the type commonly present on this type of machine, such as the control unit of the telehandlers 1, suitably programmed to perform the functions described. The various modules can correspond to hardware units and/or software routines forming part of the programmed device.

The functions can be performed by a plurality of electronic devices on which the above-mentioned functional modules can be distributed. Generally speaking, the processing unit may have one or more microprocessors or microcontrollers for execution of the instructions contained in the memory modules and the above-mentioned functional modules may also be distributed on a plurality of local or remote calculators based on the architecture of the network in which they reside.

According to an important aspect of the invention, the processing means 2 according to the invention also include a calculation module 24, configured to determine a potential stability condition, as a function of the operating parameters acquired and an output module 25 configured to provide the operator with information representing the potential stability condition. The calculation module 24 may be configured as or may consist of the system for limiting the overturning moment or similar to it.

In practice, the simulator according to the invention is designed to receive parameters on the variable functions which the telehandler 1 could adopt (in detail, geometrical parameters and the load parameter), calculating the stability condition associated with that combination of parameters, for example a machine potentially stable or a machine potentially unstable, and communicating them to the operator, for example by means of the above-mentioned user interface 22, in this case connected also to the output module 25.

In other words, the stability of the telehandler 1, that is, the safe condition wherein it does not overturn, depends on fixed factors, such as the structure of the machine, the materials with which it is made, its mass and others, known in advance and variable factors, such as the load C, the area and the shape of the supporting base A of the stabilisers, that is, their lateral extension, the length and the inclination of the arm 12 and, if necessary, the position of the turret 17 (if present).

Based on the hypothetical operating condition defined by the combination of the parameters received from the acquisition module 21, the simulator returns to the operator (at least) information on the fact that the operation which he/she wishes to perform is possible without risks for the stability or cannot be allowed by the safety system, because it potentially results in instability.

These aspects will be considered in the description of the operation of the invention.

More specifically, the user interface 22 may be configured for the representation, for use by the operator, of graphic indices associated with the potential stability conditions determined by the calculation module 24, such as numbers, diagrams, graduated scales and so on.

Preferably, the calculation module 24 is configured to determine whether the telehandler 1 would be potentially stable if said load C is located in said position and, in that case, determine a tilting angle and a length or extension of the arm suitable to allow the given load to be located in the above-mentioned position.

More in detail, the calculation module 24 may also be configured to determine maximum load values, as a function of possible positions in which it can be positioned by the arm, corresponding to a potential stability of the telehandler 1; in other words, on the basis of coordinates of the destination position of the load, defined by the horizontal distance and the height from the ground, the calculation module 24 determines which load value can be moved preserving the stability condition.

According to a preferred embodiment of the invention, the calculation module 24 comprises a first moment module 241 configured to determine a stabilising moment of the telehandler 1 as a function of the above-mentioned operating parameters, a second moment module 242 to determine a tipping moment as a function of the operating parameters and a comparison module 243 to check if the ratio between the stabilising moment and the tipping moment is greater than or equal to or less than a predetermined safety factor.

The safety factor, which preferably is a number greater than 1, is characteristic of the telehandler 1 and the comparison indicated above makes it possible to establish whether, under the operating conditions given, the operations to be performed are safe with regard to the stability.

Figure 2:
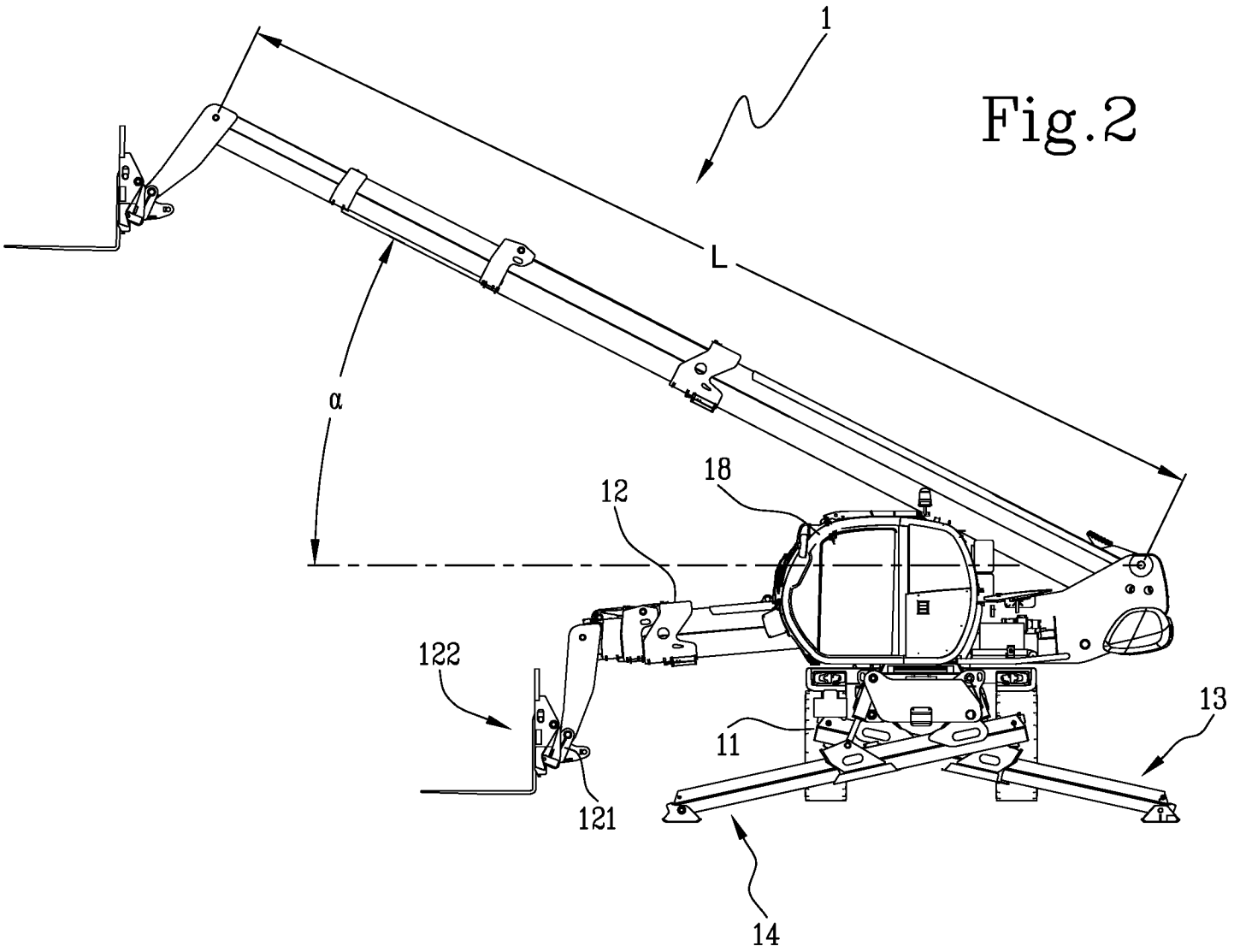
FIG. 2 is as shown in FIG. 1, where the telescopic operating arm of the telehandler is shown in two different positions.

Further, the output module 25 may be configured for producing display signals as a function, at least, of the potential stability condition and the angle of inclination $\alpha$ and the length L of the arm 12 which have been determined by the calculation module 24 on the basis of the load C to be moved and the destination position in which it should be positioned; these signals are designed to generate, using display means (for example, a display unit), graphical indices representing the fact that the machine 1 would be in a stable or unstable condition and which length L and angle of inclination $\alpha$ the arm 12 should have to perform the required task (see example in FIG. 2, where the load is not shown).

Moreover, the output module 25 may also be configured for producing second display signals, as a function of the above-mentioned determinations of the calculation module 24 and designed to produce, using display means, graphical indices representing the maximum values of the weight of the load C, in accordance with the various possible destination positions, maintaining a condition of stability of the telehandler 1. In this case, therefore, the operator displays the maximum load which can be carried in a certain desired position without creating risks for the stability. The various operating modes of the simulation system described above can be summarised into three main types of operation, not necessarily mutually exclusive and which do not exhaust the possibilities of implementing the invention, which are briefly described below.

A first step, shared by the various operating modes, is the choice of the accessory 122 to be used to perform the task which the operator sets. In effect, on the basis of the accessory mounted on the attachment device at the end of the arm 12, there is a variation in the load diagram to be applied, the maximum speed of the movements of the arm and the maximum capacity; the collection of the diagrams, speed and capacity corresponding to the various accessories can be recorded on a memory module (not illustrated) of the processing means 2, which may be connected, amongst others, to the above-mentioned calculation module 24.

More in detail, an important distinction, even if not the only one, between the various types of accessories to be used is between those which have a capacity corresponding to the nominal capacity of the telehandler 1 and those which have a lower capacity.

The accessories which have a capacity less than the nominal capacity of the machine 1, such as loading cages or arms with hooks and others, have a fixed value of the maximum load which can be carried.

For this reason, the first functional parameter which the simulator must acquire is an identifier of the accessory selected by the operator which is entered/selected in the processing means 2, for example by an interface, or which is detected automatically, preferably by a sensor located on the removable attachment device 121 (for example, a RFID reader or the like), connected to the processing means 2; in the second case, the operator attaches the accessory to the attachment device 121 and, by automatic recognition, the acquisition by the simulator of the parameter of the accessory is obtained.

There are three fundamental factors which, together with the functional parameter of the accessory, are able to define a complete simulation of the operating conditions, determining two of which, the simulator returns the third.

Amongst these, there is the stability area A; as mentioned above, it is determined by the degree of extension of each sliding member 131, 141, 151, 161, which, in the case of scissor stabilisers of the example shown, correspond to four functional parameters for the processing means. As mentioned, these parameters may be entered by the operator or detected by the above-mentioned sensors associated with the stabilising arms.

It should be noted that the stabilising area A can also correspond to a zero percentage of extension of the above-mentioned members, if the telehandler can/must work resting on its wheels 11.

A further fundamental factor is the working area, which is basically determined by the final position to which the load is to be moved and, therefore, by the functional parameters relative to the angle of inclination $\alpha$ and the length L of the arm 12, as well as the parameter of the angular position $\beta$ of the turret 17 (if present).

The third factor is the parameter relative to the load C to be moved, which can also be entered by means of an interface by the operator or it can be acquired automatically using one or more sensors, for example located on the accessory designed to measure the weight of the load once taken by the accessory itself or determined automatically by the safety system of the machine, on the basis of the pressure values of the hydraulic cylinders associated with the arm and the geometry of the machine, or by means of yet other methods.

The simulation system according to the invention is therefore configured in such a way that, by providing or acquiring the parameters relating to two of the above-mentioned fundamental factors, plus the choice of the accessory, it returns to the operator the values corresponding to the remaining parameters (or parameter).

If the accessory has a capacity less than the nominal capacity of the telehandler 1, the functional parameter of the load is constant and defined in advance by the fixed value consisting precisely of the capacity of the accessory.

According to a first operating mode, the operator has a good knowledge of the area surrounding the telehandler 1, in particular has awareness of the available space for positioning the machine 1.

Figure 3:
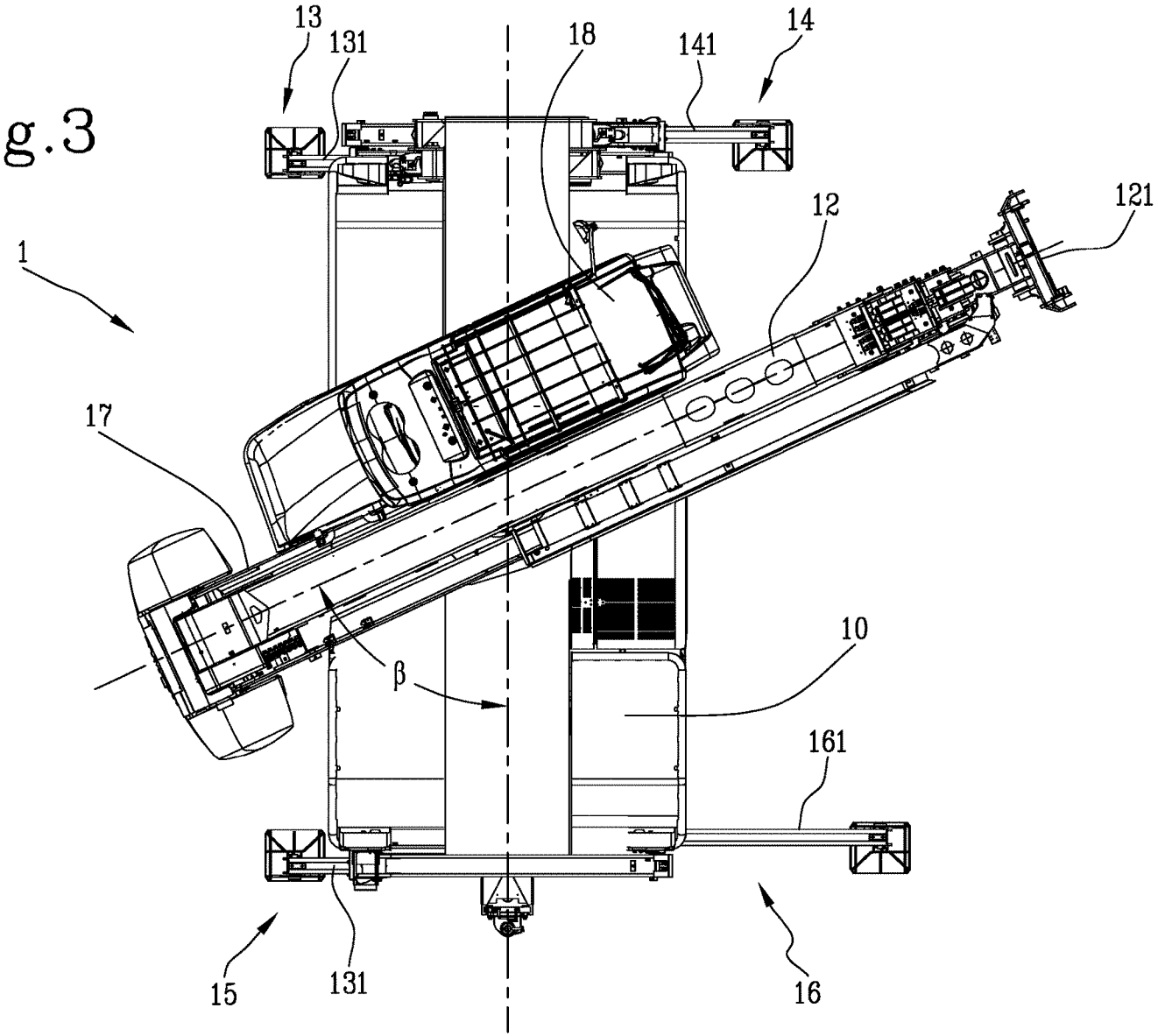
FIG. 3 is a top view of the telehandler of the preceding drawings, with the turret in a different angular position and the stabilising arms withdrawn in a non-uniform manner.
Figure 4:
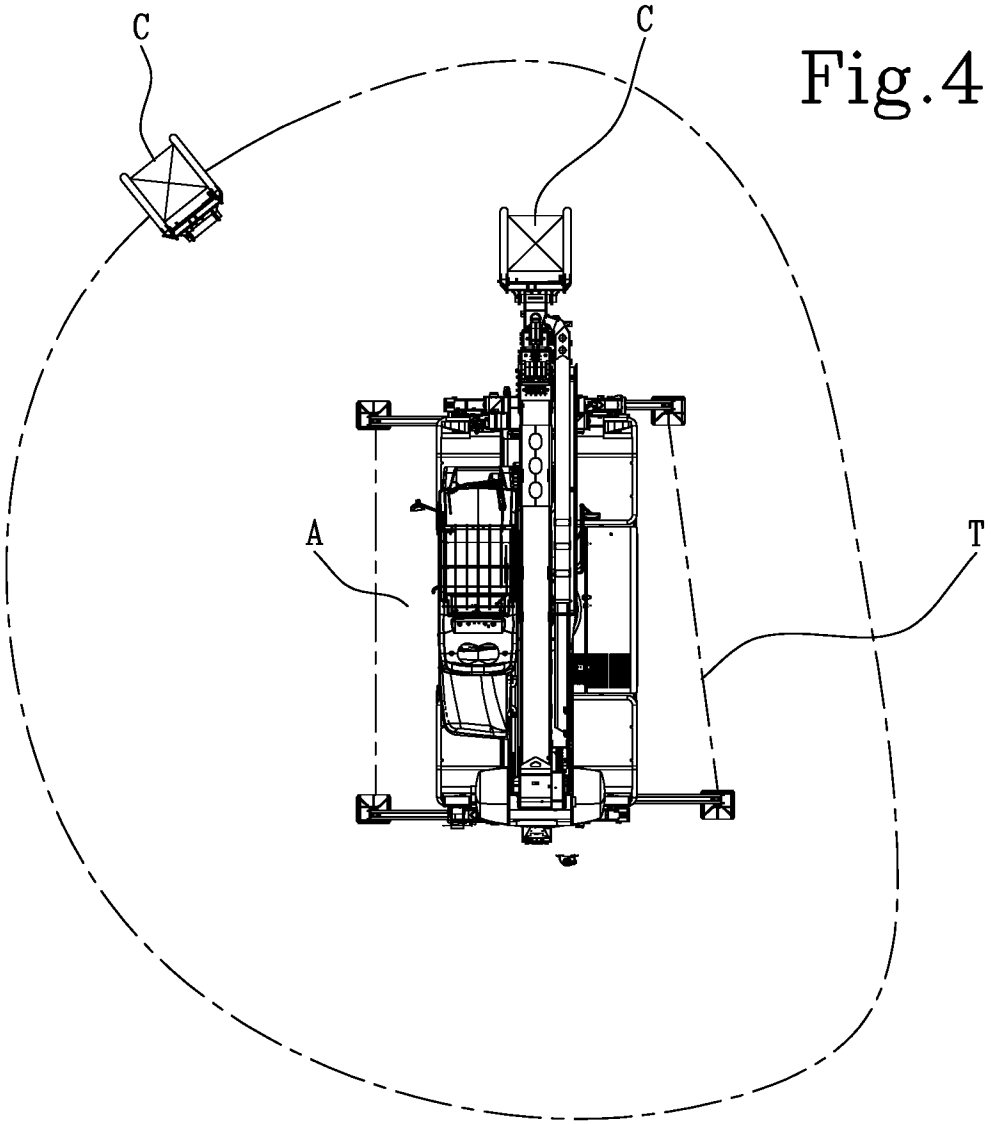
FIG. 4 is a schematic top view which schematically represents possible positions wherein the telehandler can carry the load in a condition of stability, in accordance with a hypothetical example of operating conditions.
Figure 5:
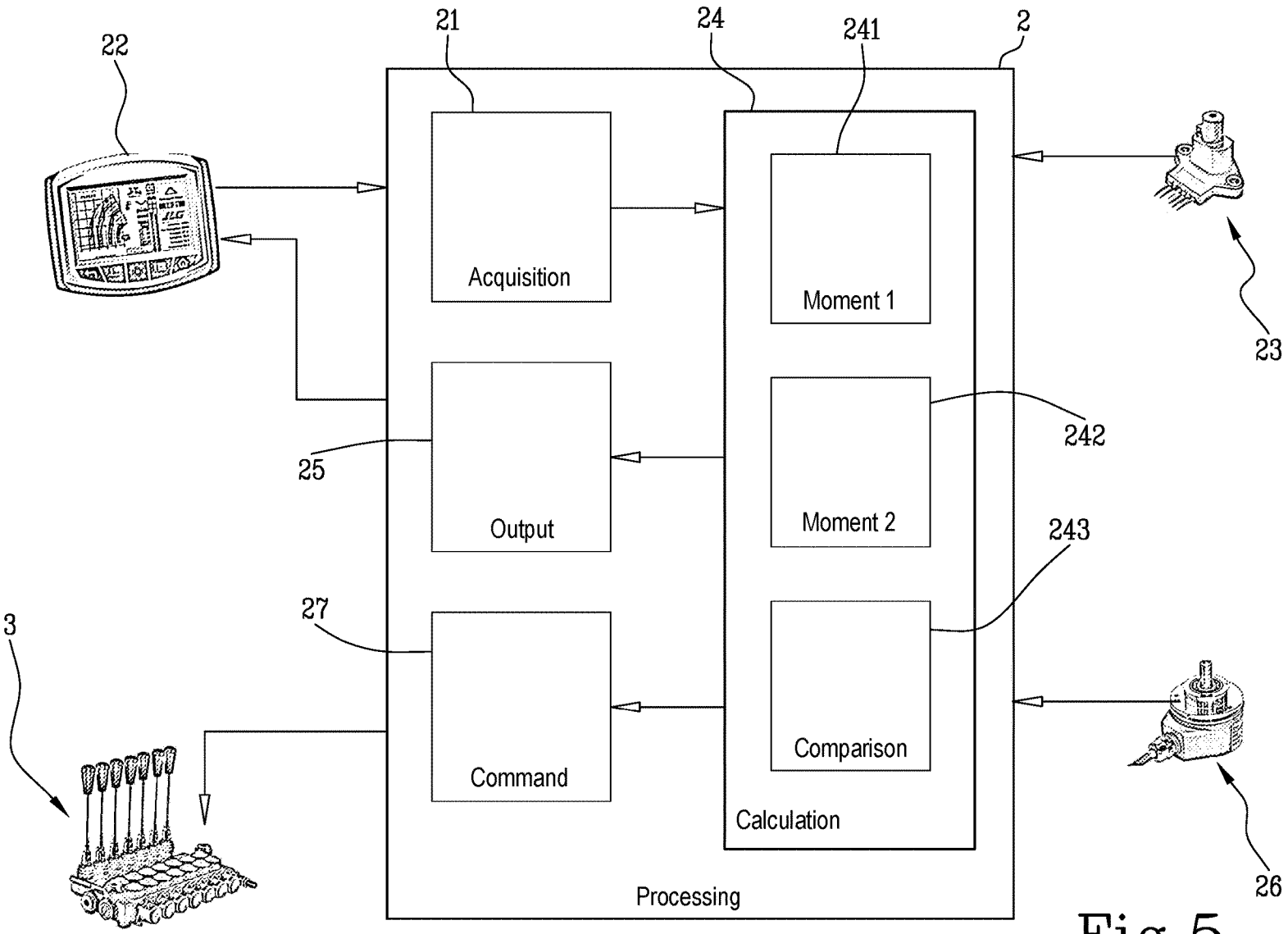
FIG. 5 is a diagram representing the simulator according to the invention.

For example, the operator is actually with the machine 1 at the work site, close to an obstacle which does not allow the stabilisers 13, 14, 15, 16 to be extended completely on one of the sides of the vehicle 1 (a condition such as that of the example shown in FIG. 3 or in the diagram of FIG. 4).

In this case, after the choice of the accessory 122, the operator can laterally withdraw the stabilisers 13, 14, 15, 16, by the allowed length, which is recorded for each stabilising arm or detected automatically by suitable sensors 23, which have already been mentioned; this information is therefore acquired by the processing unit 2 and, as mentioned, the option of working on tyres is also valid, which will obviously be suitably parameterised and acquired by the processing means 22.

In the same way, the operator enters in the simulation system the value of the weight of the load C, unless the accessory 122 has a fixed capacity, in the above-mentioned sense, the height relative to the ground level and the distance from a central point of the machine 1, for example from the centre of rotation of the turret 17, which characterise the position in which the load is to be moved, and receives from the system the simulation of the stability condition associated with those operating conditions and, if there are no risks, the value of the lifting angle $\alpha$ of the arm and its length L (or the degree of sliding) which allow the load to be moved to the desired position. According to a different type of operation, the operator knows the space available for positioning the machine 1 which in practical terms translates into the measurement of the functional parameters which represent the permitted degree of sliding for each stabilising device 13, 14, 15, 16, as in the previous operation; it should be noted that, as already mentioned, the operations start with the choice of the accessory 122 and working on tyres is taken into consideration.

Moreover, in the case of a rotary telehandler 1, the angular position $\beta$ of the turret 17 is known, for example because it is in fact prepositioned in the orientation useful for the operations to be performed and the its relative angle is read by the operator and entered through the interface or automatically acquired by the simulator by means of a sensor 26.

The simulator will respond to these inputs, for example by means of the display of the interface 22, returning the range of coordinates, with relative maximum values of the load, wherein the latter can be positioned under stable conditions; obviously, if the accessory has a fixed capacity, only the range of coordinates will be collected.

In a further operating mode, the operator knows the load C to be moved or is using an accessory with a fixed capacity, knows the position in which to move the load/accessory, the relative operating parameters being entered by the operator by means of the display or acquired by means of sensors and the simulation system provides information regarding the parameters relative to the stabilising area A necessary to stabilise the telehandler 1 in such a way as to allow the execution of the desired operation.

In the latter case, the information translates into the degree of extension of the stabilising arms required to obtain the calculated stabilising area A (which can be considered as zero if the machine is rested on the wheels 11); according to an optional variant of this method, the processing means comprise a self-stabilising module, not illustrated, configured for producing a stabilising signal designed to control the stabilisers in such a way as to stabilise the machine 1 with the area A calculated.

In practice, the processing means will produce a stabilising signal which is received by the distributor and automatically controls the cylinders of the stabilising arms in such a way that they extend and lower to the ground, lifting the vehicle in such a way as to obtain the necessary stabilising area

A.

Examples of possible mathematical functions used by the calculation module 24 are described below, in a static condition of the machine 1, the possible dynamic conditions being obtainable by the use of correction coefficients which vary from machine to machine.

As already explained, so that the telehandler 1 is stable, the ratio between the stabilising moment $M_s$ and the tipping moment $M_r$ must be greater than or equal to a safety factor SF, that is, $$SF \leq \frac{M_s}{M_r}.$$

The stabilising moment $M_s$ is calculated with the following formula:

$$M_s = G_t \cdot (C_t - L_{rib}) G_c \cdot (C_c - L_{rib}),$$

where $G_t$ is the mass of the turret, $C_t$ is the centre of gravity of the turret relative to the centre of rotation of the turret, $G_c$ is the weight of the carriage, $C_c$ is the position of the barycentre of the turret relative to the centre of rotation of the turret and $L_{rib}$ is the distance of the overturning line with respect to the centre of rotation of the turret. The overturning moment $M_r$ is calculated with the following formula:

$$M_r = (F_1 \cdot Q + F_2 \cdot F) \cdot (R - L_{rib}) + G_a \cdot (R - L_q + C_a - L_{rib}) + G_o \cdot (R - L_q + C_o - L_{rib}) G_b * [(X_b \cdot \mathrm{COS}\ \alpha) - d - L_{rib}],$$

where Q is the mass of the load, F is the mass of the arm at the distal end, R is the distance of the load with respect to the centre of rotation of the turret, $L_q$ is the distance of the load from the head pin of the telescopic arm, $G_a$ is the mass of the accessory, $C_a$ is the position of the barycentre of the accessory relative to a reference on the telescopic arm, $G_o$ is the mass of the joint at the head of the telescopic arm, $C_o$ is the position of the barycentre of the joint at the end of the telescopic arm, $G_b$ is the mass of the telescopic arm, $X_b$ is the position of the barycentre of the telescopic arm, α is the angle of lifting of the arm relative to the ground, d is the distance of the rotation pin at the base of the arm relative to the centre of rotation of the turret, $L_{rib}$ the distance of the overturning line relative to the centre of rotation of the turret and $F_1$ and $F_2$ are two empirical corrective factors which depend on the specific machine and/or on the conditions of use.

According to a particular embodiment, the processing means 2 include a control module 27 configured to generate a control signal designed to automatically move the operating arm 12 to the position associated with the length L and the angle α determined by the calculation module 24 and corresponding to the destination position of the load C.

In other words, the simulator may also comprise, after determining the length L and the angle α of the arm 12 which correspond to the destination position of the load C, if the telehandler 1 is in a safe condition, the arm 12 is automatically moved so as to move the load to that position.

More precisely, the processing unit 2 sends the control signal to the distributor 3 which consequently controls the hydraulic cylinders which drive the telescopic arm 12.

Preferably, the control module 27 is designed to generate the above-mentioned control signal only after receiving an consent signal produced by a command which can be operated by an operator, such as, for example, a pushbutton located in the cab 18.

The invention claimed is:

1. A simulation system for telehandlers equipped with a movable operating arm, designed to lift and move loads and stabilisers, comprising a plurality of movable stabilising arms, said system comprising electronic processing means which include:

an acquisition module configured to receive at least functional parameters relating to operating conditions of said stabilising arms;

wherein said acquisition module is set up to receive at least one functional parameter concerning a position where it is possible to place a load;

a calculation module configured for determining at least one potential stability condition, as a function of said operating parameters;

wherein said calculation module is configured to determine whether the telehandler would be potentially stable if said load is located in said position and, in that case, determine a lifting angle and a length of the arm suitable to allow the load to be located in the above-mentioned position; and an output module configured to provide an operator with information representing said condition of potential stability.

2. The system according to claim 1, wherein said acquisition module is set up to receive a plurality of functional parameters relative to arrangements of the respective stabilising arms.

3. The system according to claim 1, wherein the acquisition module is set up to receive at least one functional parameter relative to said load.

4. The system according to claim 1, used with a telehandler comprising a movable carriage on wheels on which is located a rotary turret which has the operating arm, wherein the above-mentioned acquisition module is set up for receiving at least one functional parameter relative to the angular position of said turret.

5. The system according to claim 1, wherein the acquisition module is set up to receive a functional parameter relative to a height at which said load can be positioned and a functional parameter concerning a relative distance at which the load can be positioned.

6. The system according to claim 1, wherein the calculation module-P is configured to determine maximum load values, as a function of possible positions in which it can be positioned by the arm, corresponding to a potential stability of the telehandler.

7. The system according to claim 1, wherein the calculation module comprises a first moment module configured to determine a stabilising moment of the telehandler as a function of said operating parameters, a second moment module to determine a tipping moment as a function of the above-mentioned operating parameters and a comparison module to check if the ratio between said stabilising moment and said tipping moment is greater than or equal to or less than a predetermined safety factor.

8. The system according to claim 1, wherein said output module is configured for producing display signals, as a function of the potential stability condition, of said angle and of said length determined by the calculation module and designed to generate, using display means, graphical indices representing said stability condition, said angle and said length.

9. The system according to claim 6, wherein the output module is configured for producing display signals, as a function of the determinations of the calculation module, designed to produce, using display means, graphical indices representing said maximum load values for respective possible positions in which the load can be carried in conditions of stability of the telehandler.

10. The system according to claim 1, comprising a user interface connected to or integrated with the processing means and configured for the insertion or the selection of said functional parameters by an operator and for the representation, for use by the operator, of graphical indices associated with the conditions of potential stability determined by the calculation module.

11. The system according to claim 1, wherein the processing means include a control module configured to generate a control signal designed to automatically move the arm to the position associated with the length and the angle determined by the calculation module and corresponding to the destination position of the load.

12. The system according to claim 11, wherein the control module is designed to generate said control signal following receipt of an enabling signal produced on a command which can be actuated by an operator.

* * * * *